United States Patent [19]

Seifert

[11] 4,343,239

[45] Aug. 10, 1982

[54] ELECTROMAGNETIC RELEASE MECHANISM FOR PRINT HAMMERS OR THE LIKE

[75] Inventor: Hans-Gordon Seifert, Weil im Schonbuch, Fed. Rep. of Germany

[73] Assignee: International Business Machines Corporation, Armonk, N.Y.

[21] Appl. No.: 202,898

[22] Filed: Oct. 31, 1980

[30] Foreign Application Priority Data

Nov. 2, 1979 [DE] Fed. Rep. of Germany ..... 2944287

[51] Int. Cl.[3] ..... B41J 9/30

[52] U.S. Cl. ..... 101/93.34; 101/93.48; 335/234

[58] Field of Search ..... 101/93.34, 93.48, 93.29, 101/93.33; 335/179–186, 229–239, 306

[56] References Cited

U.S. PATENT DOCUMENTS 3,359,921 12/1967 Arnold ..... 101/93.34

4,290,356 9/1981 Hehl ..... 101/93.48 X

FOREIGN PATENT DOCUMENTS 2837602 3/1980 Fed. Rep. of Germany .

*Primary Examiner*—Richard J. Apley

*Assistant Examiner*—A. Heinz

*Attorney, Agent, or Firm*—John S. Gasper

[57] ABSTRACT

A magnet movable under the influence of magnetic edge forces is arranged between stationary magnets.

The magnet is surrounded by a release coil in such a manner that the coil part contributing to the force active in the release direction is located in the space formed by the stationary magnets.

3 Claims, 5 Drawing Figures

ELECTROMAGNETIC RELEASE MECHANISM FOR PRINT HAMMERS OR THE LIKE

DESCRIPTION

1. Technical Field

The invention concerns an electromagnetic release mechanism which is suitable in particular for the actuation of print hammers.

2. Background of the Invention

A plurality of print hammer actuators are known, for example, from U.S. Pat. No. 3,359,921 wherein the print hammer is supported by two parallel unilaterally clamped leaf springs. The energy stored in the deflected state of the print hammer is used for print hammer actuation. The print hammer is kept in a biased state by an electromagnet. However, print hammer actuators of this kind have relatively high energy requirements.

Known further, from copending U.S. patent application of W. H. Hehl, Ser. No. 066,156 filed Aug. 13, 1979, now U.S. Pat. No. 4,290,356, and German Offenlegungsschriften No. 28 37 602, are arrangements for use in printers, which utilize so-called rare earth magnets.

The arrangement in accordance with copending application of W. H. Hehl comprises a method of operating a holding system for release mechanisms with a moving element, which is characterized in that the released moving element, under the influence of magnetic forces or under the influence of a spring, is accelerated in the operating direction, and that for the holding state, by the potential field of one or several magnetic edges being superimposed by a further potential field, based on a mechanical bias of the moving element by the spring and/or on a magnet, a total potential distribution with a relatively stable position of high potential energy is generated for the moving element, out of which the moving element is released by applying a release force overcoming the holding position.

An arrangement for implementing this method is characterized in that a moving element is provided with a first magnet which is moved past one or several magnets, and that a further magnet is provided ensuring the relatively stable holding position.

The arrangement in accordance with German Offenlegungsschriften No. 28 37 602 is an arrangement for the contactless conversion of rotational energy into energy of a translatory or pivotal motion of a spring-mass-oscillator, characterized in that on the spring-mass-oscillator a first magnet is arranged, that on a pivotable shaft a second magnet is arranged, that the second magnet or a magnetically conductive element connected thereto is moved past the first magnet, forming magnetic edge forces, so that the spring-mass-oscillator can be deflected.

DISCLOSURE OF THE INVENTION

It is the object of the invention to provide an electromagnetic release mechanism, in particular for use in print hammer actuators, which permits generating a relatively high kinetic energy at minimum space requirements and a low release energy.

This problem is advantageously solved in accordance with the invention by means of the measures specified in the characterization of claim 1.

Advantageous further developments of the invention may be seen from the sub-claims.

BRIEF DESCRIPTION OF THE DRAWINGS

Embodiments of the invention will be described in detail below with reference to the accompanying drawings in which.

BEST MODE FOR CARRYING OUT THE INVENTION

Figure 1:
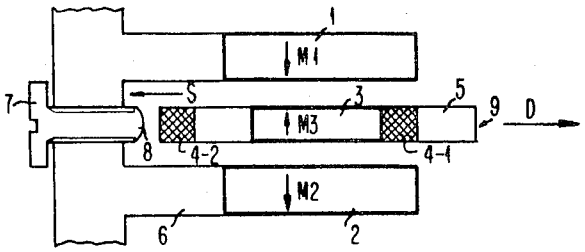
FIG. 1 is a schematic sectional representation of an electromagnetic print hammer release mechanism.
Figure 2:
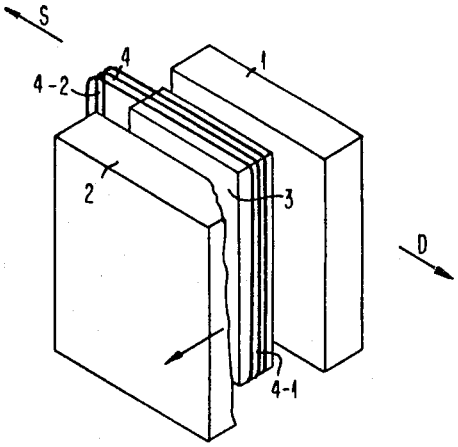
FIG. 2 is a schematic detail perspective representation of a movable magnet surrounded by a coil and arranged between two stationary magnets in accordance with FIG. 1.

FIG. 1 is a schematic sectional representation of an electrically controlled print hammer release mechanism. In this mechanism, a magnet 3, surrounded by a coil, is movably arranged between two stationary magnets 1 and 2. The magnet 3 is shorter in the operating direction D than the stationary magnets 1 and 2. The directions of magnetization of the stationary magnets 1 and 2 are identical and designated as M1 and M2, respectively. The direction of magnetization M3 of the movable magnet 3 extends oppositely to the direction of magnetization of the former two magnets 1 and 2. The direction of magnetization of all magnets 1, 2, 3 extends perpendicularly to the operating direction D of the magnet 3. For a ready appreciation of the shape of the magnets and their mutual arrangement, attention is drawn to the perspective representation in FIG. 2. Around magnet 3 a coil 4 is arranged. The arrangement of this coil is subject to the condition that the coil parts 4-1 (marked by solid black lines) contributing to the force active during the release process extend inside the space of high magnetic flux density, which is formed by magnets 1 and 2. The coil part designated as 4-2, which extends outside that space, is arranged in an area of low magnetic flux density and contributes only slightly to the release force. The magnets used must be difficult to demagnetize. Such a requirement is met in particular by rare earth magnets. Because of their high magnetic energy density, only small magnet volumes are required, and the magnets retain their magnetization even in open magnetic circuits with repulsive magnets. Under the influence of so-called magnetic edge forces between the magnets 1 and 3 and 3 and 2, respectively, the movable actuator element 9 is forced into a stop position marked by arrow S. This stop position may be formed, for example, by a setscrew 7 arranged at the base of the U-shaped carrier 6 for magnets 1 and 2. The movable magnet 3 and the coil 4 are molded to form a base with a hammer head 5 (see also FIG. 3), which in its totality forms the actuator element 9. For releasing the actuator element 9 from its stop position in the direction of arrow D, the coil 4 is subjected to a release current. The essential force active in the direction of arrow D is produced by means of the coil part 4-1 in the magnetic field of magnets 1 and 2 (this force would be cancelled if coil part 4-2 were arranged in the same field between magnets 1 and 2).

As a result of this force, magnet 3 is transferred, via a neutral position, from the area of the edge forces active in direction S to the area in which the edge forces active in direction D are present. The kinetic energy necessary for printing is imparted on actuator element 9 by means of these edge forces.

Further details concerning magnetic edge forces may be seen from copending U.S. application of H. W. Hehl. With regard to the qualitative identification of the usual magnet forces, the Hehl application draws attention to the well-known fact that when two identical magnet poles are brought close to each other, high repulsive forces occur which decrease as the distance between the magnet poles is reduced. In addition to such forces encountered in connection with repulsive configurations, there are, of course, those occurring in connection with attractive configurations. In the latter case, unidentical magnet poles are brought close to each other.

Magnetic edge forces are forces which occur as mutually attractive or repulsive magnets are moved past each other in the operating direction. The actuator element 9 may be restored to its initial position by means of mechanical restoring forces or by means of a restore current to be applied to the coil 4. In the latter case, the coil part 4-2 in the deflected position of the actuator element 5 would have to be in the area of high magnetic flux density between magnets 1 and 2, so that a restore current would cause a force to be exerted in the direction of arrow S. As a result, the magnetic edge forces active in the direction of arrow D would be overcome until the magnetic edge forces active in the direction of arrow S between magnets 1 and 3 and 2 and 3, respectively, would force the actuator element 9 to its stop position.

Figure 3:
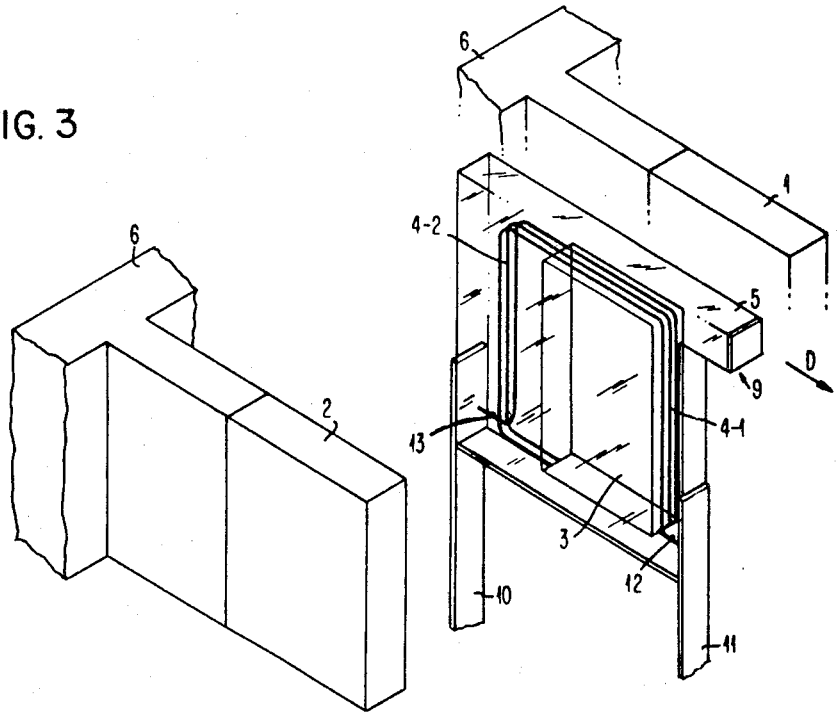
FIG. 3 is a detail perspective representation of a print hammer bank with an arrangement of FIG. 1 designed as a print hammer.

FIG. 3 shows an expanded detail perspective representation of a print hammer bank. For simplicity's sake, the setscrew 7 (see FIG. 1) for the stop position of the actuator element 9 has been eliminated in FIG. 3. The actuator element 9 is designed as a print hammer and is supported in a known manner on two leaf springs 10 and 11. The coil connections are designated as 12 and 13 and may be connected to the leaf springs 10 and 11, via which the current supply would be effected. The actuator element 9 may be designed in many different ways. Thus, for example, the base of this element could be designed in a plastic monocoque design including the magnet 3 and the coil 4. On its impact face the print hammer head 9 may be metallized. The leaf springs 10 and 11 may be connected to the actuator element by means of an adhesive joint, for example. The operation of this arrangement in accordance with FIG. 3 during printing is the same as that described in connection with FIG. 1. In such a case, the actuator element 9 would be restored to its initial position with the aid of the leaf springs 10 and 11 which would additionally serve the guide said actuator element. The leaf springs are biased by the edge forces at the same time at which the kinetic energy of the actuator element 9 is generated. As a result, the neutral position of the actuator element 9 would be moved to a position in the direction of arrow D. In this neutral position, the actuator element 9 would be restored by the leaf springs after printing, without using further restoring forces. Apart from the part shown in FIG. 3, it is pointed out that neighboring actuator elements in such a print hammer bank are always provided with a common fixed stationary magnet (1 or 2) arranged between them; an exception to this rule being the actuator elements located at the ends of the print hammer bank.

Figure 4:
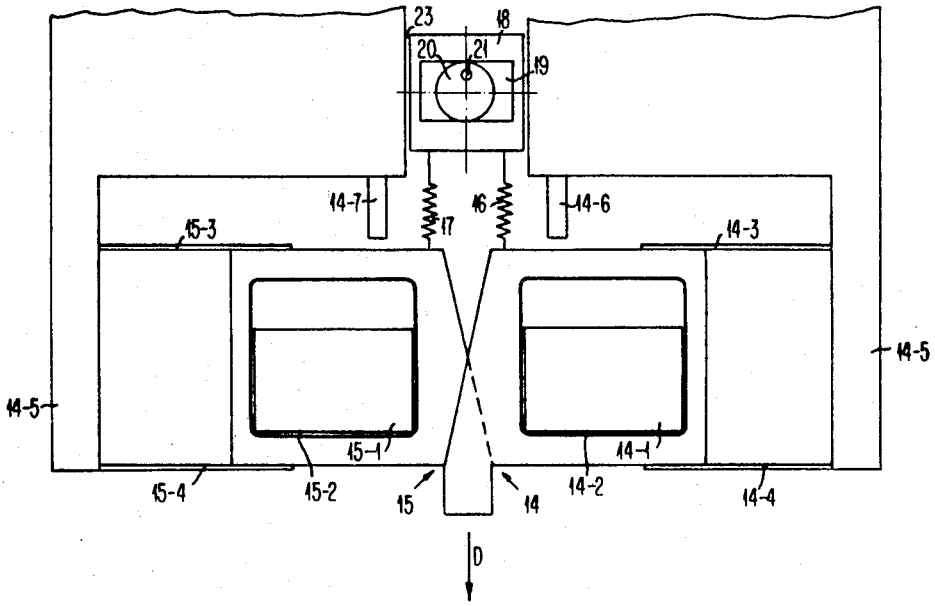
FIG. 4 is a plan view of a print hammer bank with print hammers staggered relative to each other and which are connected to a common restore mechanism.

FIG. 4 is a plan view of a print hammer bank with print hammers staggered relative to each other and with a restore mechanism. For simplicity's sake, only two print hammers 14 and 15 arranged one above the other are shown. As illustrated in FIGS. 1 and 3, each print hammer consists of a base in which a magnet and a coil surrounding the latter are embedded. Each print hammer is guided by two leaf springs. The two print hammers are staggered relative to each other in such a manner that their leaf springs are fixed at opposite points of the print hammer bank and that their hammer heads in a row are aligned to each other. The base of the print hammer bank is designated as 14-5 and the two print hammers as 14 and 15. The print hammer 14 comprises the magnet 14-1 with the coils 14-2 surrounding it. Print hammer 14 is connected to the upper limb of the base 14-5 via leaf springs 14-3 and 14-4. This applies in analogy to hammer 15 arranged below hammer 14 in FIG. 4 and whose magnet is designated as 15-1 and whose coil surrounding said magnet is designated as 15-2. The leaf springs 15-3 and 15-4 supporting said hammer are connected to the lower limb of base 14-5. For simplicity's sake, the stationary magnets including magnet 14-1 and 15-1, respectively, are not shown. With a suitable current flowing in coils 14-2 and 15-2, respectively, a release force is exerted on the corresponding print hammer in the direction of arrow D. For jointly restoring all print hammers of the print hammer bank to their initial position, a common restore mechanism is provided. This mechanism consists of a guide piece 18 reciprocally movable in a guide 23 and which via elastic elements 16 and 17 is connected to the rear ends of the print hammers 14 and 15. These elastic elements may be tension springs. The guide piece 18 is driven via an eccentric drive 21/20. This eccentric drive (stationary axis 21 with an acentric eccentric disk) acts in a recess 19 in guide piece 18. Upon rotation of the eccentric, guide piece 18 performs a stroke in guide 23, so that the elastic elements restore the deflected print hammers to their initial position beyond the area of the edge forces active in direction D to the area of the edge forces active in direction S. The initial position is determined by the stops 14-6 and 14-7 respectively.

Figure 5:
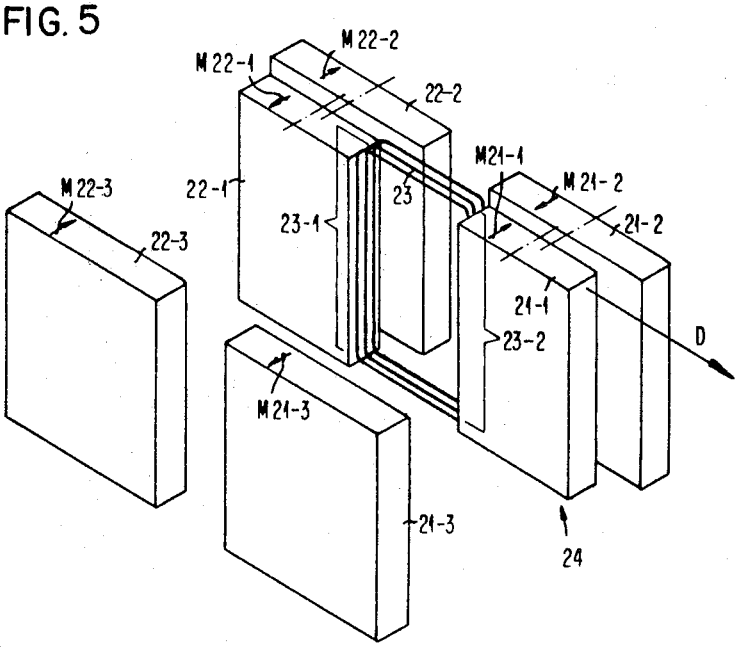
FIG. 5 is an expanded perspective representation of three magnet pairs, one pair of which connected to a coil is movably arranged between the stationary other magnet pairs.

FIG. 5 shows an expanded perspective representation of three magnet pairs, one of which connected to a coil is movably arranged between the remaining stationary other magnet pairs. With this arrangement, both sides (23-1 and 23-2 of the coil 23 of the actuator element 24 are invariably arranged in an area of high magnetic flux density, which is generated by the magnet pair 22-2/22-3 and 21-2/21-3, respectively. The adjacent magnet pairs 22-2/22-3 and 21-2/21-3 are aligned relative to each other. The magnets of these magnet pairs are spaced from each other in such a manner that an actuator element 24 movable in the direction of arrow D can be arranged between them. This actuator element consists of a magnet 22-1, a coil 23 and a magnet 21-1 following each other. The magnet 22-1 is arranged between the magnets 22-2 and 22-3, and the magnet 21-1 is arranged between the magnets 21-2 and 21-3. The magnets 22-1 and 21-1 (viewing in the operating direction of actuator element 24) have a shorter length than the magnets 22-2, 22-3, 21-2 and 21-3. In this manner, the space remaining between magnets 22-1 and 21-1 is sufficient for parts 23-1 and 23-2 of coil 23, which contribute to the force active in the direction of arrow D, to be located between the magnets 22-2 and 22-3 on the one hand and the magnets 21-2 and 21-3 on the other. The directions of magnetization M22-2 and M22-3 of the magnets 22-2 and 22-3 are identical and opposite to the direction of magnetization M22-1 of the magnet 22-1 arranged between them. Similarly, the directions of magnetization M21-2 and M21-3 of the magnets 21-2 and 21-3 are identical and opposite to the direction of magnetization M21-1 of the magnet 21-1 arranged between them; however, the directions of magnetization M22-1 and M22-2 are always opposite to each other. Such an arrangement ensures that a force is active in the direction of arrow D when a current flows in the coil parts 23-1 and 23-2. The special configuration of this arrangement in accordance with FIG. 5 permits both coil parts 23-1 and 23-2 to contribute to the release process of the actuator element 24 to the same extent (this being in contrast to the arrangement shown in FIG. 1). However, such a configuration necessitates a more elaborate design.

Having thus described my invention, what I claim as new, and desire to secure by Letters Patent is:

1. An actuator mechanism comprising an actuator element movable in a linear direction including an actuator permanent magnet having opposed sides parallel to the direction of motion, said actuator magnet having a magnetization vector perpendicular to the direction of motion of said actuator element, field magnet means forming an interactive magnetic field with said actuator magnet, said field magnet means comprising a pair of stationary parallel edge aligned permanent magnets on opposite sides of said actuator magnet, said stationary field magnets having a magnetization vector perpendicular with said direction of motion and anti-parallel with said magnetization vector of said actuator magnet, said stationary field of magnets having aligned front and rear edges, relative to the direction of motion, misaligned with front and rear edges of said actuator magnet and coacting therewith to produce magnetic edge forces whereby said actuator element is maintained at an initial stop position, and actuating means for moving said actuator element in said direction of motion from said stop position to a second position wherein said magnetic edge forces accelerate said actuator in said direction of motion including coil means surrounding said actuator magnet and carried by said actuator element for generating a magnetic field, said coil means having a coil plane parallel with said stationary permanent magnets, said coil means in said stop position having a first coil portion external to and a second coil portion within a high flux density region of said interactive magnetic field produced by said stationary permanent magnets, said coil means being energizable for producing a release force whereby said actuator magnet is moved against said magnetic edge forces from said stop position to said second position in which said edge forces accelerate said actuator element in said direction of motion.

2. An actuator mechanism in accordance with claim 1 in which said first coil portion is within and said second coil portion is external to said high flux density region of said interactive magnetic field when said actuator element is in said second position, and said coil means is energizable in said second position for producing a restore force in a direction opposite to said direction of motion whereby said actuator magnet is moved by said magnetic edge forces toward said stop position.

3. An actuator mechanism comprising an actuator element movable in a linear direction including first and second actuator permanent magnets having opposed sides parallel to the direction of motion and aligned one behind the other, said first and second actuator magnets having opposite magnetization vectors perpedicular to said direction of movement, field magnet means forming an interactive magnetic field with said first and second actuator magnets, said field magnet means comprising a first pair of stationary parallel permanent magnets on opposite sides of said first actuator magnet and a second pair of stationary parallel permanent magnets on opposite sides of said second actuator magnet, said first pair of stationary field magnets having a magnetization vector perpendicular with said direction of motion and anti-parallel with said magnetization vector of said first actuator magnet, said second pair of stationary field magnets having a magnetization vector perpendicular with said direction of motion and anti-parallel with said magnetization vector of said second actuator magnet, said first and second pairs of stationary field magnets having mutually aligned front and rear edges, relative to the direction of motion misaligned respectively with front and rear edges of said first and second actuator magnets and coacting respectively therewith to produce magnetic edge forces whereby said actuator element is maintained at an initial stop position, and actuating means for moving said actuator element from said stop position against said edge forces to a second position wherein said magnetic edge forces accelerate said first and second actuator magnets in said direction of motion including coil means carried by said actuator means between said first and second actuator magnets for generating a magnetic field, said coil means having a coil plane parallel with said first and second pairs of stationary field magnets, said coil means in said stop position having a first coil portion in a high flux density region of said magnetic field of said first pair of stationary magnets and a second coil portion in a high flux density region of said magnetic field of said second pair of stationary magnets, said coil means being energizable for producing a release force whereby said first and second actuator magnets are moved against said magnetic edge forces from said stop position to a second position wherein said edge forces accelerate said actuator element in said direction of motion.

* * * * *